US007617548B2

(12) United States Patent
Johnston

(10) Patent No.: US 7,617,548 B2
(45) Date of Patent: Nov. 17, 2009

(54) GASKET FOR INSTALLING A SINK IN A COUNTER AND METHODS OF USING SAME

(76) Inventor: John Johnston, 439 Marquis La., Lexington, KY (US) 40502

( * ) Notice: Subject to any disclaimer, the term of this patent is extended or adjusted under 35 U.S.C. 154(b) by 721 days.

(21) Appl. No.: 11/196,932

(22) Filed: Aug. 4, 2005

(65) Prior Publication Data

US 2007/0028379 A1 Feb. 8, 2007

(51) Int. Cl.
*E03C 1/33* (2006.01)

(52) U.S. Cl. ..... 4/631

(58) Field of Classification Search ..... 4/619, 4/630–636

See application file for complete search history.

(56) References Cited

U.S. PATENT DOCUMENTS

| | | | | |
|---|---|---|---|---|
| 2,836,831 | A * | 6/1958 | Hurwitz | 4/631 |
| 3,028,605 | A * | 4/1962 | Lander | 4/631 |
| 3,369,261 | A * | 2/1968 | Tiller | 4/633 |
| 4,175,292 | A | 11/1979 | Morrison | |
| 4,504,986 | A | 3/1985 | Vigh | |
| 4,613,995 | A | 9/1986 | Ricke | |
| 5,016,297 | A | 5/1991 | Sauter et al. | |
| 6,021,532 | A | 2/2000 | Ricke | |
| 6,108,831 | A | 8/2000 | Lombreglia, Jr. | |
| 6,216,992 | B1 | 4/2001 | Bisonaya et al. | |
| 6,267,136 | B1 | 7/2001 | Johnson | |
| 6,293,322 | B1 | 9/2001 | Wilson-South | |
| 6,446,280 | B1 | 9/2002 | Moore, Jr. | |
| 6,691,341 | B2 | 2/2004 | Loch | |
| 6,793,190 | B2 | 9/2004 | White et al. | |
| 2003/0154546 | A1 | 8/2003 | Romo | |

* cited by examiner

*Primary Examiner*—Huyen Le
(74) *Attorney, Agent, or Firm*—King & Schickli PLLC

(57) ABSTRACT

A gasket for securing and sealing a sink in an opening of a counter. The gasket includes a body having a flange adapted to engage a portion of the sink. The gasket also includes at least one projection spaced apart from the flange. The at least one projection engages an inner surface of the counter when installed. Accordingly, the gasket enables top-down, press fit installation of the sink. A method of using the gasket is also disclosed.

35 Claims, 7 Drawing Sheets

GASKET FOR INSTALLING A SINK IN A COUNTER AND METHODS OF USING SAME

TECHNICAL FIELD

The present invention relates generally to a device for securing and sealing a sink and, more specifically, to a gasket having a flange and at least one projection adapted for securing and sealing a sink in a counter using a top-down, press fit installation.

BACKGROUND OF THE INVENTION

Kitchens, bathrooms, and other facilities often have one or more sinks mounted in an opening of a counter. Generally these sinks include a rim surrounding the periphery of the sink and projecting onto a top surface of the counter. The rim functions to support the sink in the opening, as well provide a finished look for the installed sink.

To retain the sink in position, various fastening devices have been developed. Problematically, many of these devices require the installer to permanently attach a portion of the fastener to the counter. This often requires the installer to drill or otherwise deform a portion of the counter in order to attach the fastener. Should the installer miscalculate the position for the fastener, the counter may become damaged and unusable. Given the need for measuring and positioning these fasteners, they require an extensive amount of time to install. Also, given the various types of counter material, an installer may need specialized tools to drill the counter and install the fastener. Furthermore, these fasteners are relatively expensive and are prone to corrosion.

Other devices, such as retainer clips, require the installer to affix a portion of the clip to the sink. For instance, an installer may be required to weld a portion of the clip to the basin of the sink. If performed incorrectly, the welding may result in damaging the sink. Moreover, the welding process also requires specialized tools and increases the amount of time for installation.

Retainer clips and other fasteners also require the installer to access the underside of the sink to complete the securing process. For instance, the installer may need to tighten nuts or other fasteners to complete the attachment of the sink to the fasteners. Due to the minimal amount of space under the sink, special tools are often necessary to access the undersink fasteners. This further increases the amount of time and cost for the installation.

At some point during the installation, the installer has the additional task of sealing the sink to the counter. Sealing the sink helps prevent moisture from seeping under the rim and possibly damaging the counter or area under the sink. Since this step is separate from the securing step, this further increases the time and cost for installing the sink.

Accordingly, the plumbing arts have need for a device that would allow an installer to install the sink without the attachment of hardware to the counter. Moreover, the need exists for a device that enables a top-down, press fit installation of the sink. The device would enable the installer to secure and seal the sink in a single step, therein decreasing the installation time and related cost.

SUMMARY OF THE INVENTION

In accordance with the purposes of the present invention as described herein, a new and improved gasket for securing and sealing a sink is described. The gasket includes a body having a flange adapted to engage a portion of the sink and at least one projection extending from the body and spaced apart from the flange. Positioning the gasket between the sink and an opening of a counter secures and seals the sink in the opening.

In one embodiment, the body comprises an endless belt having the flange positioned substantially at one end of the body. The flange outwardly extends from the body and includes a curved top surface to engage an undersurface of a rim of the sink. The flange may also include a substantially planar bottom surface adapted to engage the top surface of a counter. The flange may also include a recess to enable compression of the flange under the rim.

The at least one projection may be unitary with the body or may be a separate member, such as a pin or blade retained in the body. The projection may also be positioned at an acute angle to the body. The body may also include a receiver adapted to receive a portion of the sink.

In accordance with a further aspect of the invention, a method of securing and sealing the sink in counter is disclosed. The method comprises positioning a gasket, including a body having a flange and at least one projection extending from the body and spaced apart from the flange, between the sink and the counter. The positioning step may also include placing the gasket about the sink such that a portion of the body engages a basin of the sink and the flange engages an undersurface of a rim extending outwardly along the periphery of the upper edge of the sink. The method may further include the step of engaging the at least one projection with an inner surface of the counter. The method may also include the step of compressing the flange having a recess under the rim, such that a first surface of the recess contacts a second surface of the recess when compressed. Also, the method may include the step of associating an anchor of the sink with a receiver positioned on the body.

In the following description there is shown and described one possible embodiment of this invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention.

In the drawings.

DETAILED DESCRIPTION OF THE INVENTION

Figure 1:
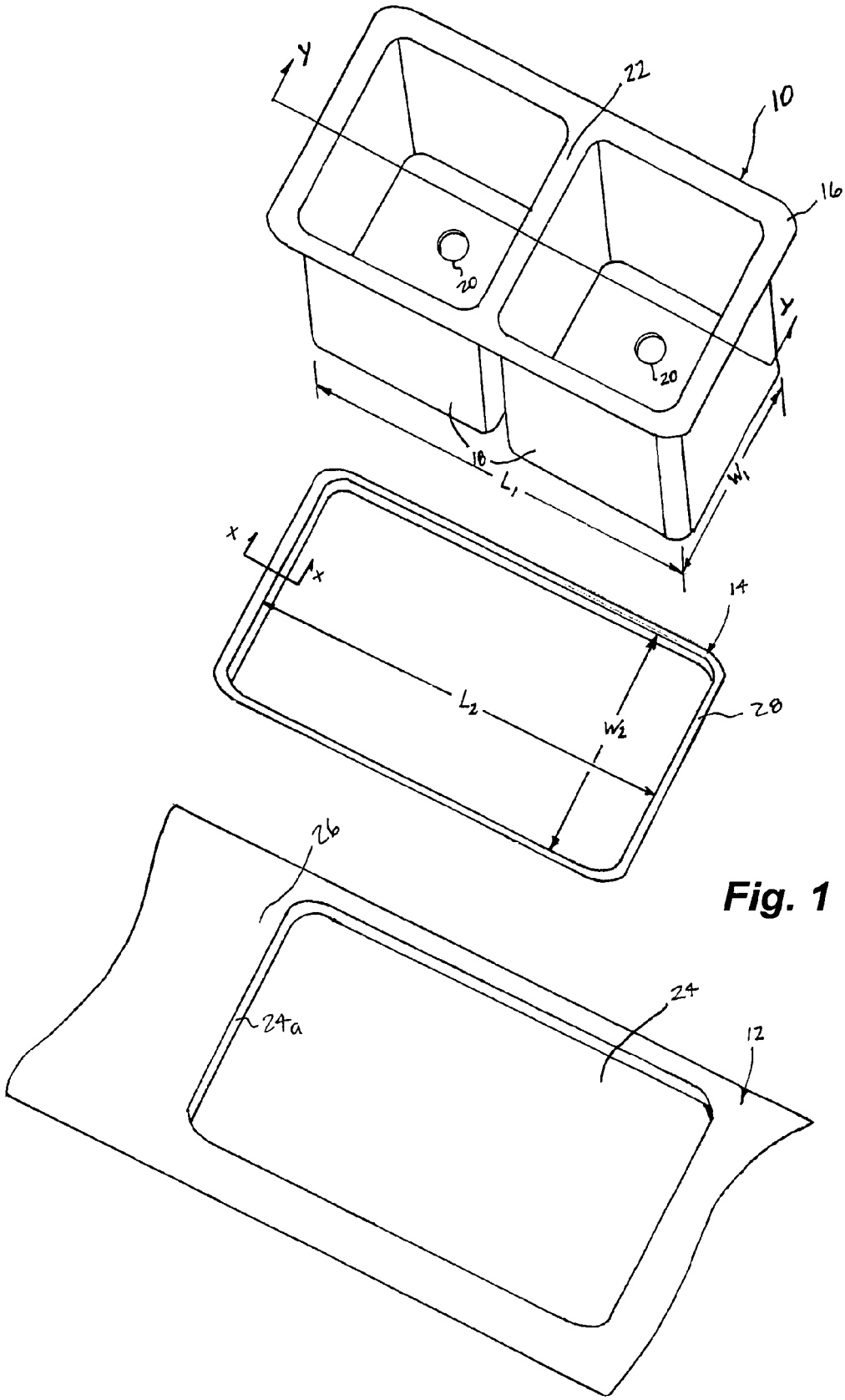
FIG. 1 is an exploded perspective view of a sink to be secured and sealed in an opening of a counter utilizing one embodiment of the gasket of the present invention.

Reference is now made to the exploded view of FIG. 1 illustrating a sink 10 to be installed in a counter 12 utilizing one embodiment of the device 14 of the present invention. The sink 10 becomes secured to the counter 12 with the device 14 of the present invention. In one embodiment, the device 14 comprises a gasket 28 that enables a top-down, press fit installation of the sink in the counter, as discussed below in further detail.

The sink 10 includes a rim 16 extending outwardly along the periphery of the upper edge of the sink 10. The sink 10 also includes at least one basin 18 having at least one drain 20. Although shown with a substantially rectangular rim 16 and a divider 22 forming two basins 18, each having a separate drain 20, the sink 10 may take any form, shape, or size. Also, the sink may be formed of any material, but is often stainless steel, cast iron, or ceramic.

Ultimately, the sink 10 becomes installed in an opening 24 of the counter 12. The opening 24 may become formed during the manufacturing of the counter 12 or it may be cut in the counter 12 after installation, as well known in the art. Preferably, the opening 24 comprises dimensions slightly greater than the length $L_1$ and width $W_1$ of the basins 18, but less than the overall length and width of the sink 10 including the rim 16. In this configuration, the basin 18 may project through the opening 24, while the rim 16 rests on a top surface 26 of the counter 12.

In accordance with one aspect of the invention, the gasket 28 functions to both secure the sink in the opening 24 of the counter 12 and seal the rim 16 to the top surface 26 of the counter 12. In the embodiment shown in FIG. 1, the gasket 28 takes the form of a endless belt having a substantially rectangular shape similar to the outline of the opening 24 the gasket 28 will secure and seal. The gasket 28 has an inner length $L_2$ and width $W_2$ defining a large central opening 13 sized and shaped to accommodate at least one basin 18 of the sink 10. In this instance, the inner length $L_2$ and width $W_2$ are similar to the length $L_1$ and width $W_1$ of the basins 18. In one embodiment, the gasket 28 has a length $L_2$ between 30"-35" and a width $W_2$ between 20"-25". However, the gasket 28 may have any length $L_2$ and width $W_2$ corresponding to the sink 10 that it will secure and seal. Although shown as substantially rectangular, the gasket 28 may have any shape or size, such as substantially circular, oval, square, or otherwise. The gasket 28 may be formed out of any material, but would preferably be an elastomer, such as a synthetic polychloroprene rubber (e.g. neoprene). Utilizing an elastomer material, the inner length $L_2$ and width $W_2$ would preferably be slightly smaller than the length $L_1$ and width $W_1$ of the sink. This material enables a user to the stretch and pull the gasket 28 around the basin 18 of the sink 10 to ensure a tight fit.

Figure 2A:
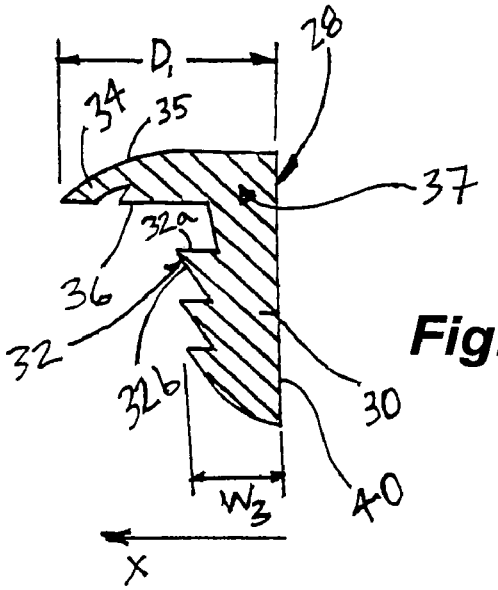
FIGS. 2*a* and 2*b* are detailed cutaway views along the line X-X of the gasket shown in FIG. 1.
Figure 2B:
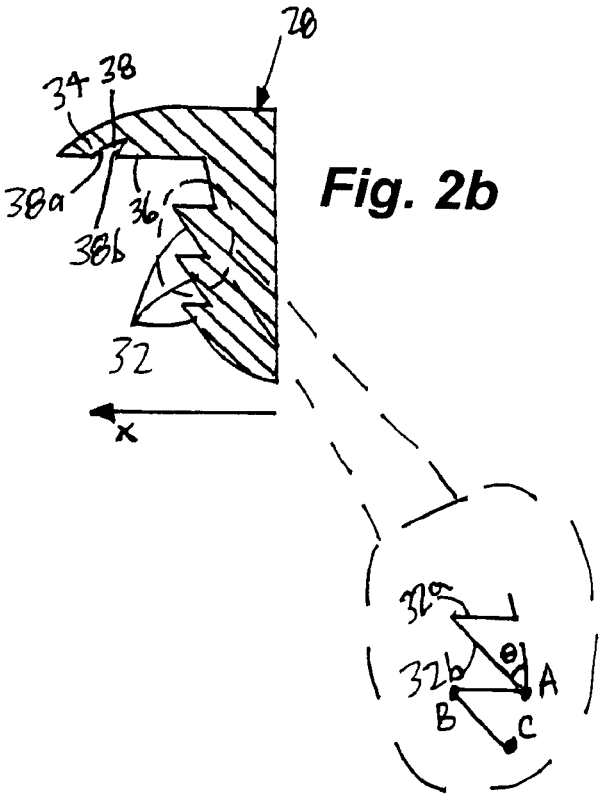
Figure 3A:
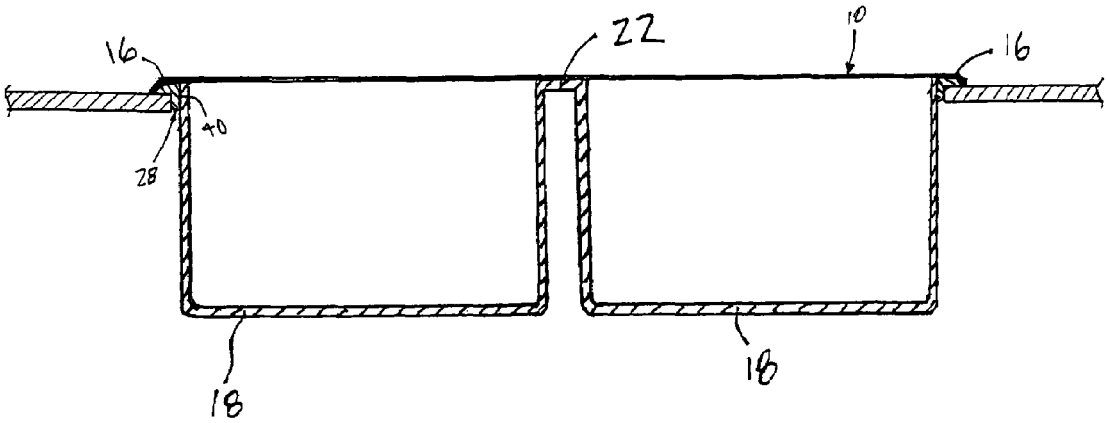
FIGS. 3*a* and 3*b* are detailed cutaway views of a sink secured and sealed using one embodiment of the gasket of the present invention.
Figure 3B:
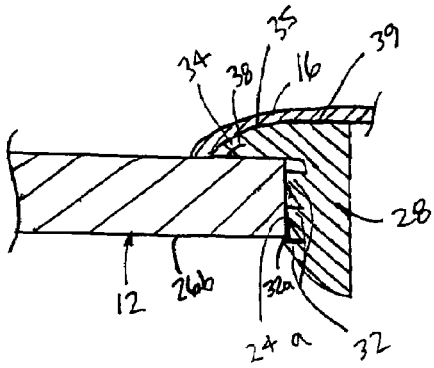

With specific reference to the detailed cutaway views of FIGS. 2*a* and 2*b*, the gasket 28 comprises a body 30 having at least one projection 32 and a flange 34. The flange 34 resides at one end 37 of the body 30 and outwardly extends from the body 30. As shown, the flange has a width $D_1$, which is greater than a width of the body $W_3$ including the projections 32. Turning to FIG. 3*b*, the flange 34 includes a top surface 35 profile similar to an undersurface 39 of the rim 16 of the sink 10. Additionally, the flange 34 includes a substantially planar bottom surface 36 adapted to rest on a portion of the top surface 26 of the counter 12 when installed. In this configuration, the top surface 35 may engage and mate with the undersurface 39 of the rim 16 and the flange 34 may completely fit within an opening between the rim 16 and the top surface 26 of the counter 12, as shown in FIGS. 3*a* and 3*b*.

Figure 7A:
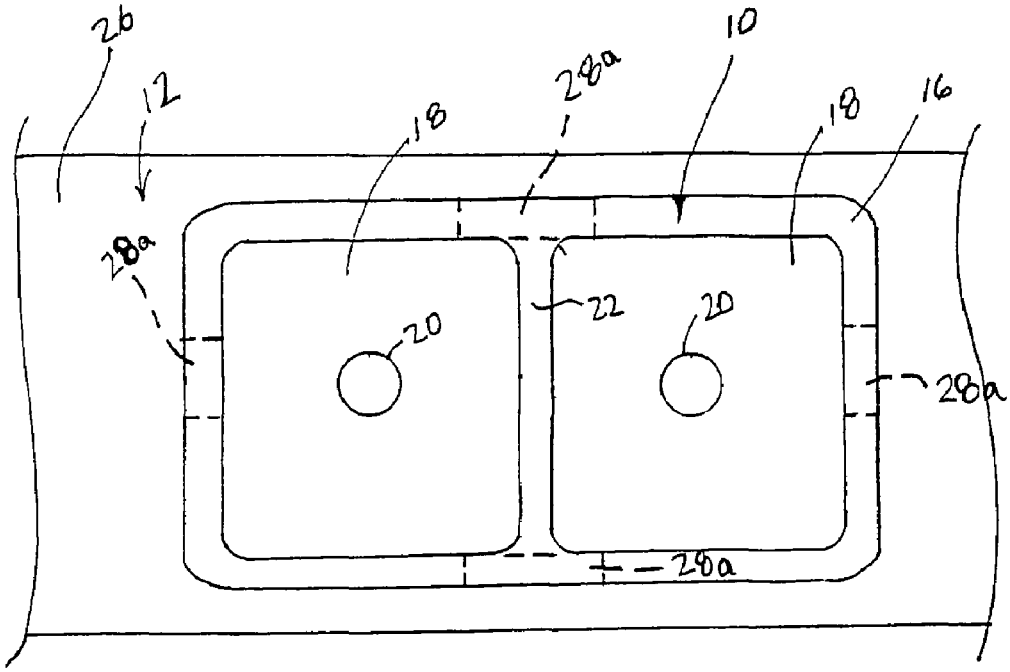
FIG. 7*a* is a top view of a sink installed with a gasket in the form of multiple segments forming one embodiment of the present invention.
Figure 7B:
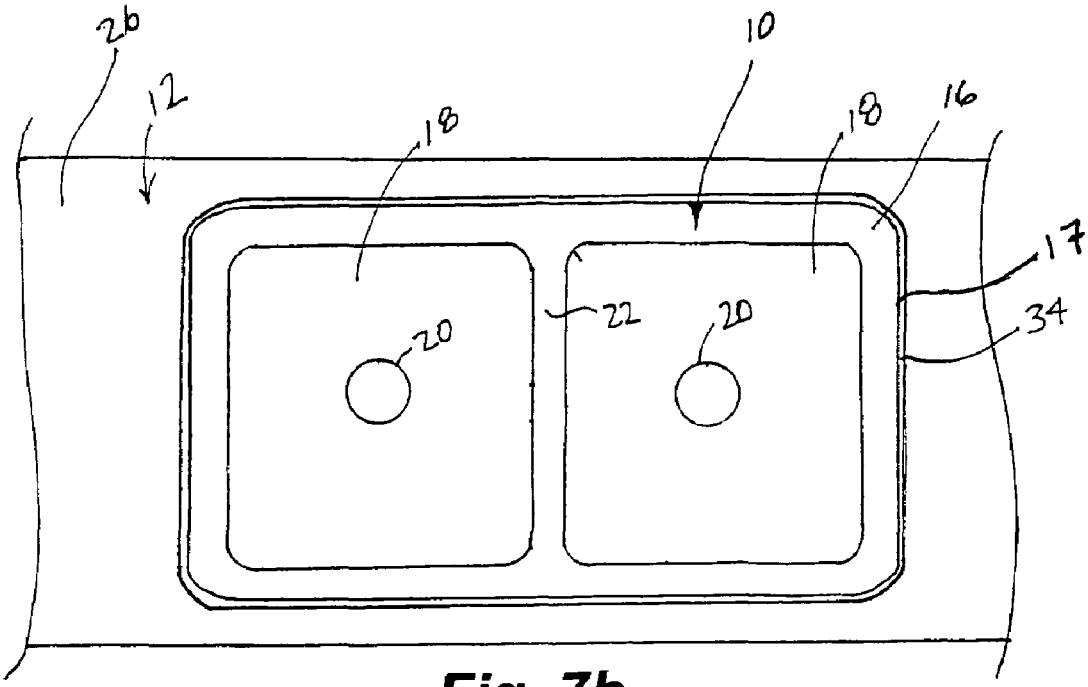
FIG. 7*b* is a top view of a sink having a flange projecting outside of a rim.

To assist the flange 34 in completely residing under the rim 16, the bottom surface 36 of the flange 34 may include a recess 38. As shown in FIGS. 2*b* and 3*b*, the recess 38 projects into the flange 34 and includes surfaces 38*a*, 38*b*. When compressed, the surface 38*a* contacts the surface 38*b*. A skilled artisan will appreciate that the flange 34 fills the space between the undersurface 39 of the rim 16 and the top surface 26 of the counter 12, therein making a tight seal between the rim 16 and the top surface 26. Although shown in FIGS. 3*a* and 3*b* as completely residing under the rim 16, the flange 34 may project outside of the rim 16 forming a frame around the periphery of the sink 10 visible from above the sink (FIG. 7*b*, discussed below).

Turning to FIGS. 2*a* and 2*b*, the projections 32 reside below the flange 34 and extend from the body 30 in the same direction X as the flange 34. Preferably, the projections 32 include a first surface 32*a* and a second surface 32*b* extending a distance less than the width $D_1$ the flange 34 extends. This amount of extension enables the projections 32 to engage the counter in the desired manner, while allowing the flange 34 to seat above the counter and under the rim 16. In one embodiment, shown in FIGS. 2*a* and 2*b*, the first surface 32*a* resides substantially perpendicular with the body 30, while the second surface 32*b* resides at an acute angle θ with respect to the body 30. This arrangement forms a projection having a substantially triangular profile between the points A, B, and C, for example. Preferably, at least one of the surfaces 32*a*, 32*b* would reside at an angle θ of 45° with the body, however, both surfaces may be at any angle.

Figure 4A:
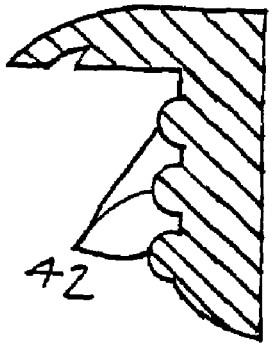
FIGS. 4*a*-4*c* are detailed cutaway views of alternate embodiments of the projection of the gasket of the present invention.
Figure 4B:
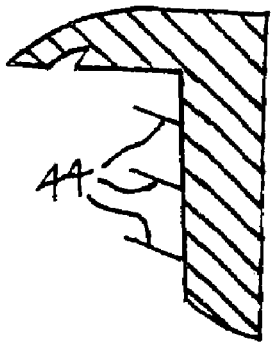
Figure 4C:
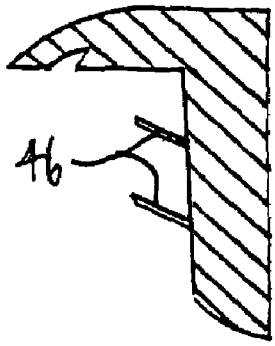

Although FIGS. 2*a* and 2*b* show a body 30 with three unitary projections 32, the gasket 28 may include any number of projections 32. Furthermore, the projections 32 may have any shape and may comprise separate members retained or otherwise supported by the gasket. For instance, the projections 32 may comprise substantially curved surfaces 42 formed as one material (FIG. 4*a*), metallic or polymer pins 44 (FIG. 4*b*), or blades 46 (FIG. 4*c*). The body 30 may be formed with the pins 44 and blades 46 or they may become retained after formation of the body. For instance, insertion of the pins 44 and blades 46 may occur from a first side 45*a* through the body 30 and out a second side 45*a*. Alternatively, the pins and blades may become inserted in the body 30 through the second side 45*a*.

Figure 5A:
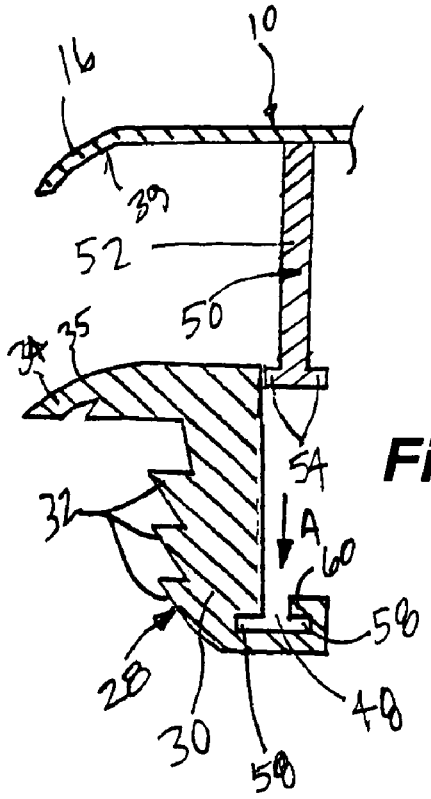
FIGS. 5*a* and 5*b* are detailed cutaway views of alternate embodiments of the present invention including a receiver.
Figure 5B:
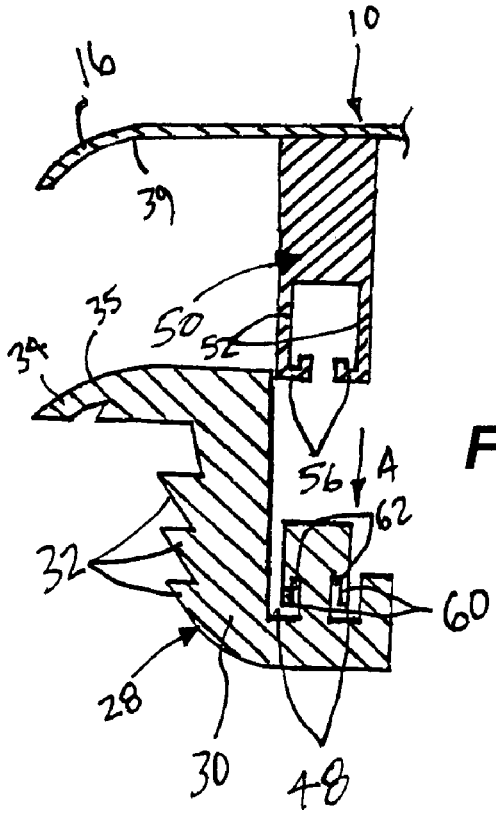

With reference to FIGS. 2*a* and 3*a*, a portion of the body 30 may also engage the basin 18 of the sink 10. In the embodiment shown, the inner surface 40 comprises a substantially planar surface such that engages a similar planar exterior surface of the basin 18. However, the body 30 may have any configuration of inner surface 40 and does not have to engage the basin 18. For instance, as shown in FIG. 5*a* and 5*b*, the body 30 may include one or more receivers 48 to receive an anchor 50 extending from the sink 10 or from a band (not shown) that may be welded to the sink 10 and positioned between the body 30 of the gasket 28 and the sink 10. The anchor 50 assists in maintaining the gasket 28 in the desired location between the counter 12 and the sink 10 during installation.

In one embodiment, the anchor 50 may take the form of a vertical post 52 having a plurality of tabs 54. The anchor 50 may also comprise a plurality of vertical posts 52 each having hooks 56. Accordingly, the anchor 50 may take any form size or shape that enables association of the anchor with the gasket 28 in the direction of the action arrows A. Similarly, the receivers 48 may take any form, but would preferably have a shape similar to the anchor 50 it will receive. For instance, as shown in FIG. 5*a*, the receiver 48 includes a plurality of substantially horizontal recesses 58 sized and shaped to receive the tabs 54 of the anchor 50. Additionally, the receiver 48 may include a projecting retainer, such as the lip 60. The lip 60 assists in maintaining the tabs 54 in the recesses 58. Turning to FIG. 5*b*, the receiver 48 may include substantially vertical recesses 62 with lips 60 to retain the hooks 56.

Figure 6:
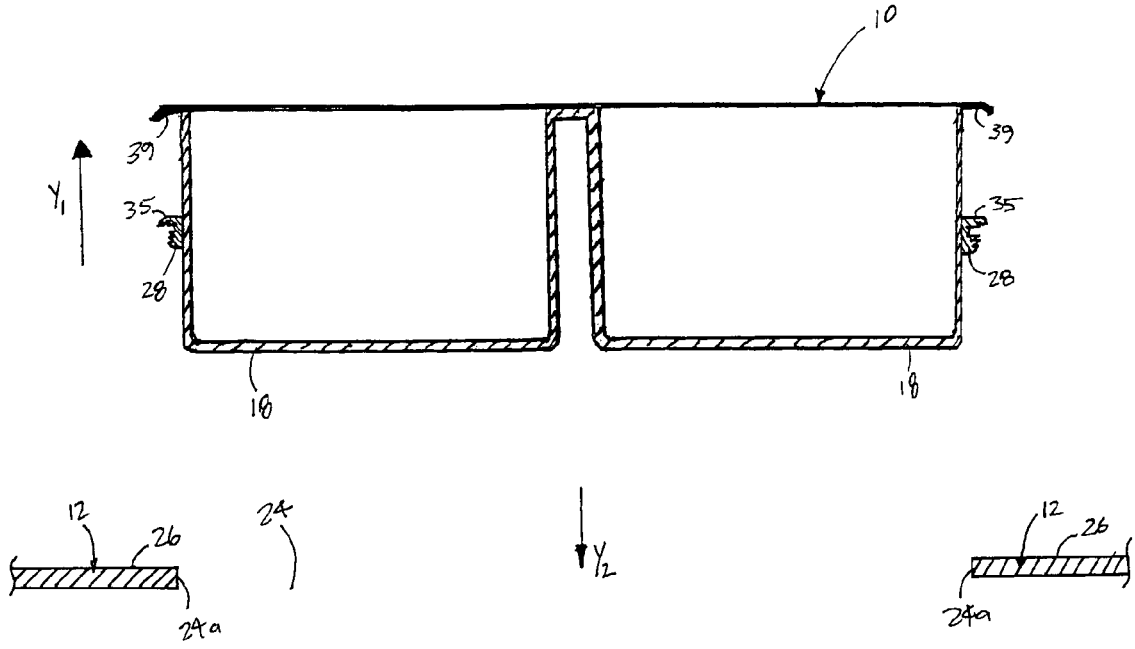
FIG. 6 is a detailed cutaway view of a sink being installed in a counter using one embodiment of the gasket of the present invention.

More specifically describing the method of associating the gasket 28 with the sink 10 and counter 12, as shown in FIG. 6, an installer positions the gasket 28 around the basin 18. When using a gasket 28 formed from an elastomer material, the installer will likely stretch the gasket 28 such that it will fit around the basin 18 and pulls the gasket 28 towards the rim 16, in the direction $Y_1$, until the top surface 35 of the flange 34 engages the undersurface 39 of the rim 16. Due to the nature of the elastomer material, it desires to return to its original, relaxed shape and will remain in place on the basin without the need for any adhesives or other material to hold it in place. However, if an installer desires to create a more permanent bond between the gasket 28 and the basin 18 or rim 16, the installer may use an adhesive as known in the art to further assist in holding the gasket 28 in place.

Next, the installer lowers the sink 10 bearing the gasket 28, in the direction $Y_2$, into the opening 24 of the counter 12. As the gasket 28 proceeds through the opening 24, the projections 32 engage an inner surface 24*a* of the counter 12. The installer continues to lower the sink 10 until the bottom surface 36 of the flange 34 and the rim 16 engage the top surface 26 of the counter 12. In one embodiment, the installer lowers the sink 10 until at least one of the first surfaces 32*a* of a projection 32 engages a bottom surface 26*b* of the counter 12, as shown in FIG. 3*b*. A skilled artisan will appreciate that the positioning of the gasket 28 between the sink 10 and the inner surface 24*a* of the counter 12 provides for a tight friction fit of the sink 10. In addition to the friction fit created by the gasket 28, the directional orientation of the projections 32 assists in securing the sink in place. The directional orientation of the projections 32 also resist lifting motion of the sink from the counter 12 in the direction $Y_1$.

Moreover, the flange 34 residing in between the counter 12 and the sink 10 functions to seal the rim 16 to the counter 12, thereby obviating the need for caulk or other material for sealing the sink 10 to the counter 12. Accordingly, the present invention consolidates the steps of securing and sealing a sink to a counter in one simple step, thereby dramatically decreasing the amount of time and cost necessary to install the sink. A skilled artisan will appreciate that the present invention enables a top-down, press fit installation of the sink from above the counter.

The foregoing discussion was chosen to provide the best illustration of the principles of the invention and its practical application to thereby enable one of ordinary skill in the art to utilize the invention in various embodiments and with various modifications suited to the particular use contemplated. For example, the device 14 may be formed from a colored material to match the color of a counter 12 or sink 10 when the flange 34 projects beyond a periphery 17 of the rim 16, as shown in FIG. 7*b*. Although the gasket may comprise a endless belt having a substantially rectangular shape, it may also take the form of multiple segments 28*a* that may become positioned around the periphery of the sink (FIG. 7*a*). In this regard, instead of positioning the gasket around the entire basin 18 of the sink 10, the installer may position the gasket 28*a* around the opening 24 of the counter 12 and press the sink 10 into place. If desired, adhesive material may be used to retain the gasket 28*a* in position. All modifications and variations are within the scope of the invention as determined by the claims when interpreted in accordance with the breadth to which they are fairly, legally and equitably entitled.

The invention claimed is:

1. A gasket intended for top-down, press fit installation of a sink in a counter, comprising:

a body having a flange adapted to engage a portion of the sink, the body having a section extending a distance below a top of the counter when the sink is installed; and at least one projection extending from the section of the body extending the distance below the top of the counter, the at least one projection for engaging an inner surface of the counter when the sink is installed.

2. The gasket of claim 1, wherein the body comprises an endless belt with a central opening sized and shaped to accommodate at least one basin of the sink.

3. The gasket of claim 2, wherein the at least one projection is unitary with the body and includes at least one surface at an acute angle to the body.

4. The gasket of claim 2, wherein the at least one projection is a separate member retained in the body.

5. The gasket of claim 4, wherein the separate member is one of a pin and a blade.

6. The gasket of claim 5, wherein the separate member is positioned at an acute angle to the body.

7. The gasket of claim 1, wherein the flange outwardly extends from the body and includes a substantially curved top surface to engage an undersurface of a rim of the sink and a substantially planar bottom surface adapted to engage the top surface of the counter.

8. The gasket of claim 1, wherein a bottom surface of the flange includes a recess to enable compression of the flange under a rim of the sink.

9. The gasket of claim 1, wherein the body further includes a receiver adapted to receive a portion of the sink.

10. The gasket of claim 1, wherein the at least one projection extends from the body in the same direction as the flange.

11. The gasket of claim 1, wherein the body engages the sink when the sink is installed.

12. A gasket intended for securing and sealing a sink in a counter, comprising:

an endless belt with a central opening sized and shaped to accommodate at least one basin of the sink, the belt having a flange positioned substantially at one end of the belt, and the belt having a section extending a distance below a top of the counter when the sink is installed; and at least one angled projection extending from the section of the belt extending below the top of the counter when the sink is installed, the at least one angled projection for engaging an inner surface of the counter when the sink is installed.

13. The gasket of claim 12, wherein the at least one angled projection is positioned at an acute angle to the belt.

14. The gasket of claim 12, wherein the flange outwardly extends from the belt and includes a substantially curved top surface to engage an undersurface of a rim of the sink and a substantially planar bottom surface adapted to engage the top surface of a counter.

15. The gasket of claim 14, wherein the bottom surface of the flange includes a recess to enable compression of the flange under the rim of the sink.

16. The gasket of claim 15, wherein the flange extends a greater distance than the width of the belt in the same direction as the at least one projection.

17. The gasket of claim 12, wherein the at least one projection is unitary with the belt.

18. The gasket of claim 12, wherein the at least one projection is a separate member.

19. The gasket of claim 18, wherein the separate member is one of a pin and a blade.

20. The gasket of claim 12, wherein the belt further includes a receiver adapted to receive a portion of the sink.

21. The gasket of claim 12, wherein the flange and the at least one angled projection extend from the body in the same direction.

22. A method of securing and sealing a sink in a counter, comprising:

positioning a gasket, including a body having a flange and at least one projection extending from the body and spaced apart from the flange, between the sink and the counter, whereby the body includes a section extending a distance below a top of the counter when the sink is installed, the at least one projection is positioned on the section extending the distance below the top of the counter, and the at least one projection engages an inner surface of the counter when the sink is installed.

23. The method of claim 22, wherein the positioning step comprises placing the gasket about the sink such that a portion of the body engages a basin of the sink and the flange engages an undersurface of a rim extending outwardly along the periphery of the upper edge of the sink.

24. The method of claim 23, further comprising the step of compressing the flange having a recess under the rim, such that a first surface of the recess contacts a second surface of the recess when compressed.

25. The method of claim 23, further comprising the step of associating an anchor of the sink with a receiver positioned on the body.

26. The method of claim 22, further comprising the step of engaging the at least one projection with an inner surface of the counter.

27. A system for securing and sealing a sink to a counter, comprising:

a sink;

a counter having an opening sized and shaped to accommodate the sink; and a gasket positioned between the sink and the counter, the gasket including a flange, a body having a section extending a distance below a top of the counter, and at least one projection extending from the section of the body extending the distance below the top of the counter, wherein the at least one projection engages an inner surface of the counter.

28. The system of claim 27, wherein the gasket is positioned about the sink such that a portion of the body engages a basin of the sink and the flange engages an undersurface of a rim extending outwardly along the periphery of the upper edge of the sink.

29. The system of claim 27, wherein the at least one projection is positioned at an acute angle to the body.

30. The system of claim 27, wherein the flange fills a space between an undersurface of a rim extending outwardly along the periphery of the upper edge of the sink and a top surface of the counter, therein making a tight seal between the rim and the top surface.

31. A gasket intended for top-down, press fit installation of a sink in a counter, comprising:

a body having a flange adapted to engage a portion of the sink, the body having a section extending a distance below a top of the counter when the sink is installed; and a plurality of projections extending from the section of the body extending the distance below the top of the counter, the plurality of projections for engaging the sink when the sink is installed.

32. The gasket of claim 31, wherein the body comprises an endless belt with a central opening sized and shaped to accommodate at least one basin of the sink.

33. The gasket of claim 31, wherein the plurality of projections are unitary with the body and each includes at least one surface at an acute angle to the body.

34. The gasket of claim 31, wherein the plurality of projections are separate members retained in the body.

35. The gasket of claim 34, wherein the separate members are one of a pin and a blade.

* * * * *